US006281847B1

(12) United States Patent
Lee

(10) Patent No.: US 6,281,847 B1
(45) Date of Patent: Aug. 28, 2001

(54) ELECTRONICALLY STEERABLE AND DIRECTION FINDING MICROSTRIP ARRAY ANTENNA

(75) Inventor: Choon S. Lee, Dallas, TX (US)

(73) Assignee: Southern Methodist University, Dallas, TX (US)

( * ) Notice: Subject to any disclaimer, the term of this patent is extended or adjusted under 35 U.S.C. 154(b) by 0 days.

(21) Appl. No.: 09/465,317

(22) Filed: Dec. 17, 1999

Related U.S. Application Data

(60) Provisional application No. 60/112,648, filed on Dec. 17, 1998.

(51) Int. Cl.[7] ..... H01Q 1/38

(52) U.S. Cl. ..... 343/700 MS; 343/853; 343/876

(58) Field of Search ..... 343/700 MS, 853, 343/829, 846, 848, 849, 876; H01Q 1/38

(56) References Cited

U.S. PATENT DOCUMENTS 4,367,474 * 1/1983 Schaubert et al. ..... 343/700 MS
4,521,781 * 6/1985 Campi et al. ..... 343/700 MS
4,777,490 * 10/1988 Sharma et al. ..... 343/754
4,933,680 * 6/1990 Shapiro et al. ..... 343/700 MS
5,777,581 * 7/1998 Lilly et al. ..... 343/700 MS
5,818,391 10/1998 Lee ..... 343/700 MS
6,002,370 * 12/1999 Mckinnon et al. ..... 343/700 MS

* cited by examiner

*Primary Examiner*—Tho Phan
(74) *Attorney, Agent, or Firm*—Oblon, Spivak, McClelland, Maier & Neustadt, P.C.

(57) ABSTRACT

An antenna having a dielectric layer configured about a longitudinal axis, and having at least two surface portions which face outwardly from the longitudinal axis in at least two different directions. A conductive ground plane is bonded to each of the at least two surface portions, and at least two conductive antenna elements are bonded to each dielectric layer on each of the at least two surface portions for radiating a signal therefrom. A transmission strip configured for transmitting a signal is connected through a switch to each of the at least two conductive elements.

34 Claims, 9 Drawing Sheets

ELECTRONICALLY STEERABLE AND DIRECTION FINDING MICROSTRIP ARRAY ANTENNA

CLAIM OF PRIORITY

This application claims priority from U.S. Provisional Patent Application No. 60/112,648 to Choon Sae Lee, entitled "Beam-Steering/Direction Finding Array Antenna" filed Dec. 17, 1998.

TECHNICAL FIELD

The invention relates generally to antennas and, more particularly, to microstrip array antennas which are electronically steerable to transmit, or identify and receive, a beam in any one of a number of different directions.

BACKGROUND

It is well-known that it is most efficient for antennas to communicate (i.e., transmit and/or receive) signals from, another antenna when the signal is communicated as a focused beam, rather than as an omni-directional signal. However, when an antenna must simultaneously communicate signals to antennas located in a number of different directions, as with local radio or television stations, it is often advantageous to use less-efficient omni-directional antennas.

One technique that has been employed to communicate signals in multiple directions is to utilize multiple antennas, each of which is configured to communicate signals in one of the multiple directions. It may be appreciated, however, that the employment of multiple antennas is expensive, and often cost-prohibitive.

Commonly, however, antennas that must communicate signals in multiple directions are only required to communicate such signals in one direction at a time. In such cases, alternatives to multiple antennas are available. In one such alternative, a single antenna may be mechanically rotated to direct, or steer, a beam as desired. Mechanically rotated antennas, however, are relatively slow and bulky, and still more expensive than desired.

In another alternative, a phased-array antenna may be used to electronically steer the antenna to transmit or receive a beam in a particular direction, or to find the direction of an incoming beam. A phased-array antenna achieves such functionality by employing a plurality of radiating elements, and a phase shifter configured to alter the input phase at each radiating element, in a manner wellknown in the art. Phase shifters, however, are relatively expensive and, for this reason, phased-array antennas are seldom used, and when they are used, such use is limited to specific applications in which cost is not a significant issue.

Accordingly, a continuing search has been directed to the development of electronically steerable antennas which may be inexpensively fabricated for transmitting and receiving signals in any of a number of different directions, and for direction-finding of an incoming beam.

SUMMARY

The present invention, accordingly, discloses an antenna having a dielectric layer configured about a longitudinal axis, and having at least two antenna element surface portions which face outwardly from the longitudinal axis in at least two different directions. A conductive ground plane is bonded to each of the at least two surface portions, and at least two conductive antenna elements are bonded to each dielectric layer on each of the at least two surface portions for radiating a signal therefrom. A transmission strip configured for transmitting a signal is connected through a switch to each of the at least two conductive elements.

The antenna disclosed by the present invention may be inexpensively fabricated for transmitting and receiving signals in any of a number of different directions, and for finding the direction of an incoming beam.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

In the following discussion, numerous specific details are set forth to provide a thorough understanding of the present invention. However, it will be obvious to those skilled in the art that the present invention may be practiced without such specific details. In other instances, well-known elements have been illustrated in block or schematic diagram form in order not to obscure the present invention in unnecessary detail. Additionally, for the most part, details concerning microstrip antennas, generally, and the like have been omitted inasmuch as such details are not necessary to obtain a complete understanding of the present invention and are within the skills of persons of ordinary skill in the relevant art. For the sake of clarity, many elements depicted in the accompanying FIGURES are not drawn to scale.

Figure 1:
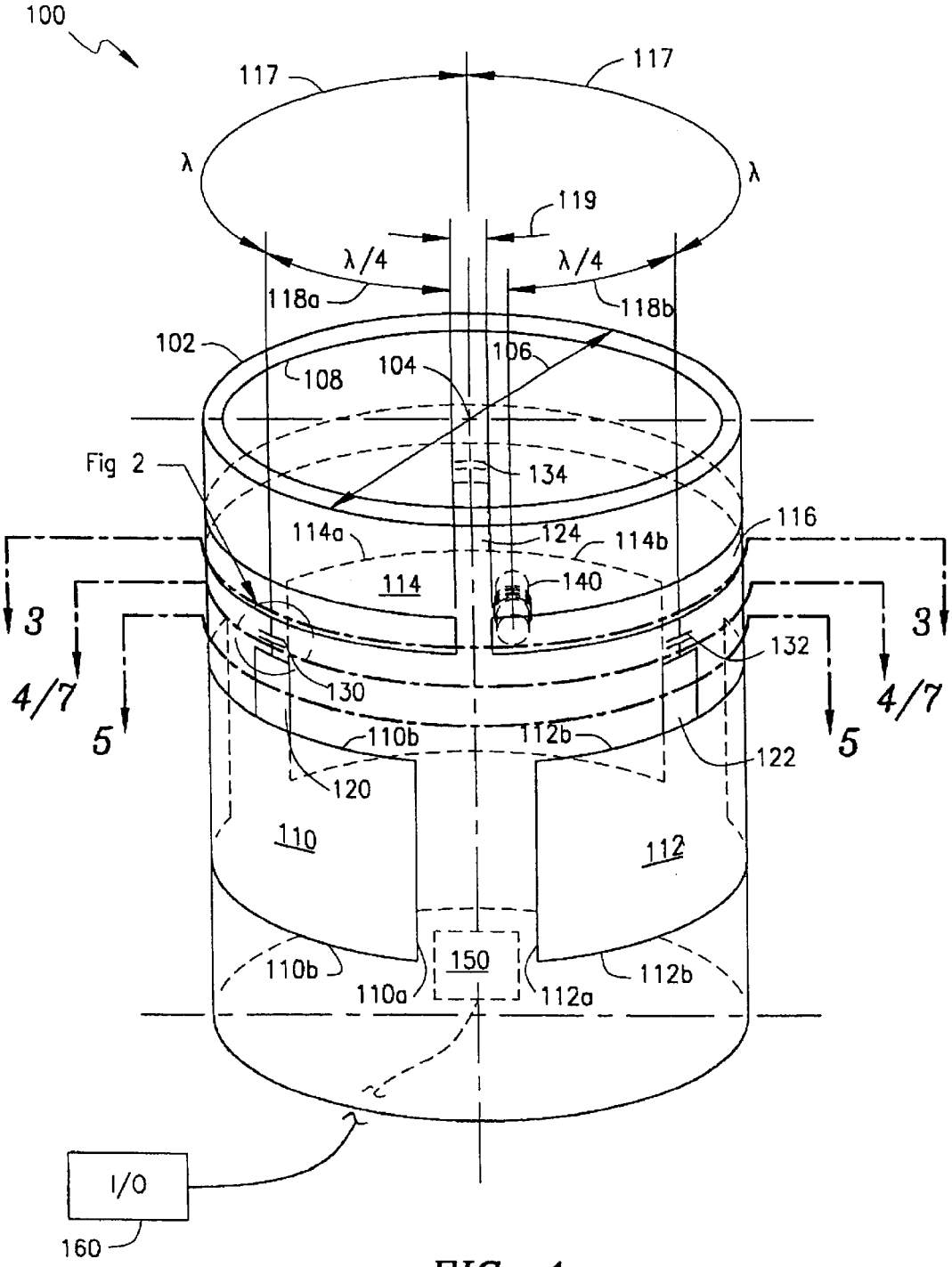
FIG. 1 is a perspective view of an antenna embodying features of the present invention.

Referring now to FIG. 1 of the drawings, the reference numeral 100 generally designates a microstrip array antenna embodying features of the present invention for transmitting, locating, and receiving beams of electromagnetic (EM) energy.

As viewed in FIG. 1, the antenna 100 includes a dielectric layer 102, respectively, configured in the shape of a cylinder about an axis 104. The dielectric layer 102 is fabricated from a mechanically stable material having a relatively low dielectric constant, typically about 2.2. An example of such a dielectric material is RT/duroid™ 5880, available from the Rogers Corporation, located in Chandler, Ariz. The dielectric layer 102 has a thickness (i.e., the radial dimension as viewed in FIG. 1) of between about 0.001 λ to about 0.100 λ and, typically, from about 0.003 λ to about 0.050 λ and, preferably, about 0.025 λ. It is understood that, unless specified otherwise, λ as used herein is taken as a wavelength in the dielectric medium. The diameter 106 of the dielectric layer 102 is discussed below.

A conductive ground plane 108 is bonded to an interior side of the dielectric layer 102. An array of preferably evenly spaced-apart conductive semi-cylindrical microstrips, or patches, referred to herein as antenna elements 110, 112, and 114 are bonded to the exterior side of the dielectric layer 102 for forming radiating antenna elements within the dielectric layer 102. The antenna elements 110, 112, and 114 are, preferably, generally rectangular in shape and, as viewed in FIG. 1, are defined by vertical radiating edges 110*a*, 112*a*, and 114*a* having a length of about λ/2, and by horizontal radiating edges 110*b*, 112*b*, and 114*b* having a length of preferably about 1.5 times the length of the vertical radiating edges 110*a*, 112*a*, and 114*a*.

The antenna elements 110, 112, and 114 are electrically coupled to a signal transmission strip 116 via respective gated strips 120, 122, and 124 and, as discussed further below, respective capacitors 130, 132, and 134. The widths of the transmission strip 116 and gated strips 120, 122, and 124 are calculated in a manner well-known in the art based on a number of different factors, such the thickness of the dielectric 102, and will therefore not be discussed further herein. The arc lengths 117 of the transmission strip 116 between each gated strip is preferably about λ, or an integral multiple thereof, and the end lengths 118*a* and 118*b* are preferably about λ/4, though the length 118*b* may be longer than λ/4, and are separated by a gap 119 of preferably at least about 0.2 λ. It is noted that, while the antenna elements 110, 112, and 114 are preferably equally spaced apart around the circumference of the dielectric 102 by a space of □ between each pair of adjacent antenna elements, the spacing between the antenna elements connected at opposite ends of the transmission strip 116, i.e., the antenna elements 110 and 112 as shown in FIG. 1, may be differently spaced, depending on the dimensions 118*a*, 118*b*, and 119. In accordance with the foregoing, the outside diameter 106 of the dielectric 102 is approximately the quotient of the sum of the gap 119 and the total length of the transmission strip 116 divided by Π, a well-known constant equal to about 3.1415.

The ground plane 108, antenna elements 110, 112, and 114, transmission strip 116, and gated strips 120, 122, and 124, comprise conductive material such as copper, aluminum, and/or silver, and are preferably bonded to the dielectric layer 102 using conventional printed-circuit, metallizing, decal transfer, monolithic microwave integrated circuit (MMIC) techniques, or chemical etching techniques, or any other suitable technique. For example, in accordance with a chemical etching technique, one of the foregoing conductive materials is clad to the interior and exterior of the dielectric layer 102, and then chemically etched away from the exterior side of the dielectric layer 102, using conventional etching techniques, until the desired antenna elements 110, 112, and 114, transmission strip 116, and gated strips 120, 122, and 124 are defined. The ground plane 108, antenna elements 110, 112, and 114, transmission strip 116, and each gated strip 120, 122, and 124 preferably have a thickness (which, for the sake of clarity, are not shown to scale in FIGS. 2–4) of approximately 1 mil (i.e., 0.001 inch).

For optimal performance at a particular frequency, the size of each of the antenna elements 110, 112, and 114, gated strips 120, 122, and 124, and transmission strip 116, and the thickness of the dielectric layer 102, are calculated so that fields radiated from the radiating edges of the antenna elements interfere constructively with one another. Additionally, the size and positioning of the antenna elements 110, 112, and 114 on the dielectric 102 and relative to each other antenna element is calculated for controlling not only the resonant frequency, but also the input impedance, of the antenna 100.

Also shown in FIG. 1 are a conventional SMA probe 140 connected to the antenna 100, control circuitry 150 operatively connected for controlling the antenna 100, and an input/output (I/O) device 160 operatively connected for controlling the circuitry 150. The SMA probe 140 is positioned at one end of the transmission strip 116 preferably a distance of λ/4 from the juncture of the capacitor 132 with the transmission strip 116, though such distance may be greater than λ/4. The SMA probe 140, circuitry 150, and I/O device 160 are discussed further below with respect to FIGS. 3 and 5.

Figure 2:
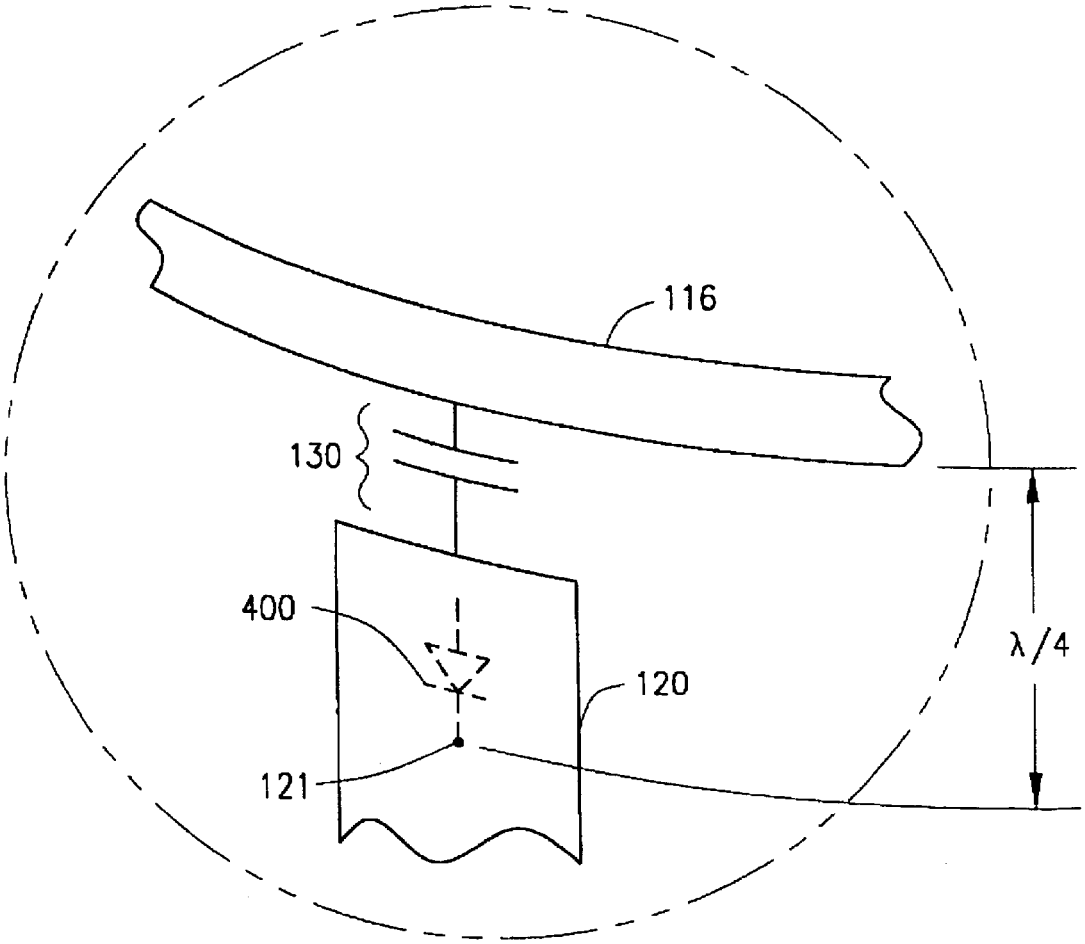
FIG. 2 is an enlarged view of a portion of the antenna of FIG. 1, which includes a capacitor.

FIG. 2 is an enlarged view of a portion of the antenna 100 showing the capacitor 130, taken as representative of the capacitors 132 and 134. The capacitors 130, 132, and 134 are configured to have suitable capacitance to pass a signal between the transmission strip 116 and the antenna elements 110, and 112, and 114. The determination of such capacitance is considered to be well-known in the art and will, therefore, not be discussed in further detail herein. As discussed further below with respect to FIG. 4, a diode 400 is connected to the gated strip 120 and, as shown in FIG. 2, is connected at a point 121 that is about λ/4 removed from the transmission strip 116.

Figure 3:
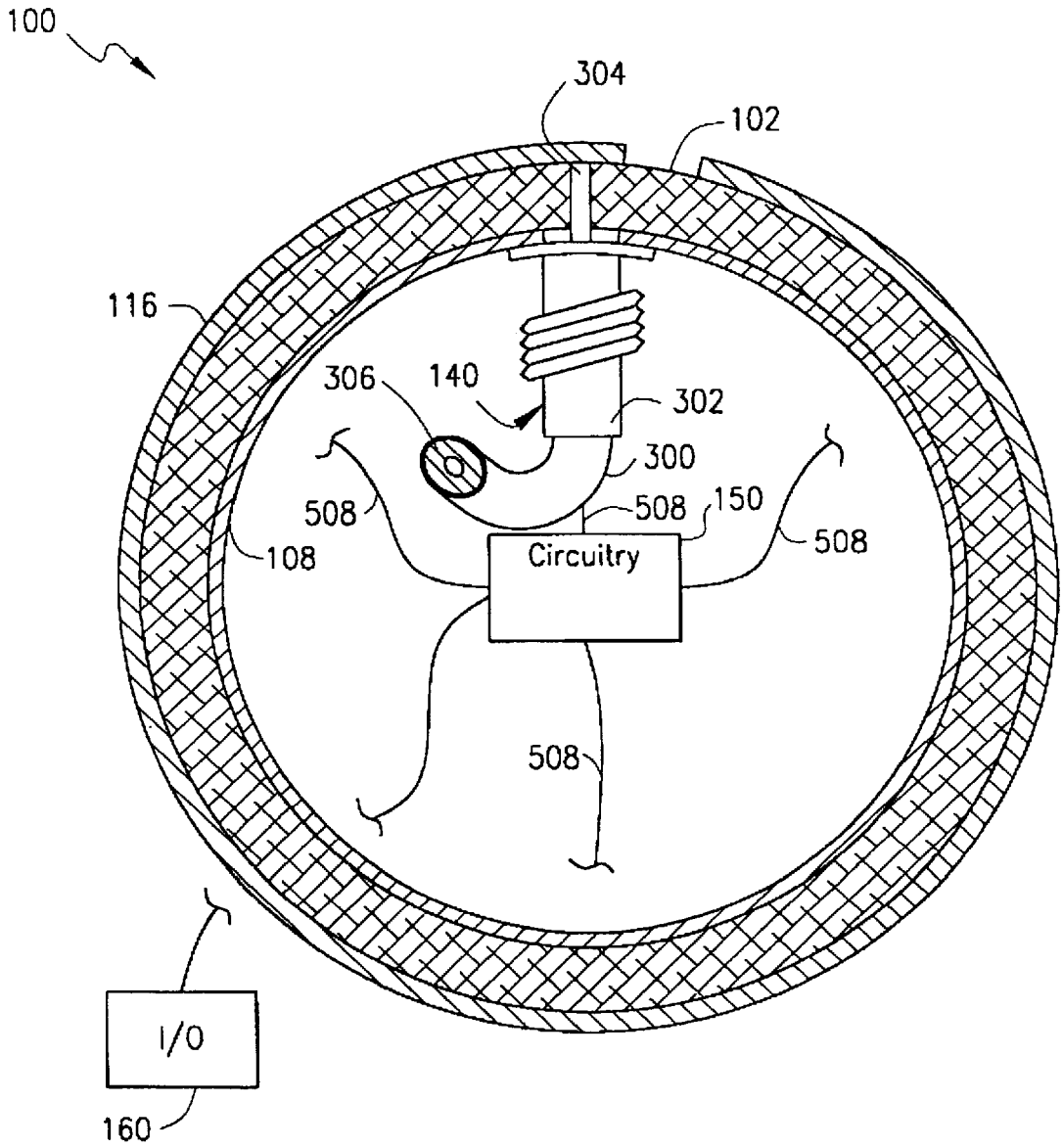
FIG. 3 is a planar view of the antenna of FIG. 1 taken along the line 3—3 of FIG. 1, depicting an SMA probe connected to the antenna of FIG. 1.

FIG. 3 depicts the connection of the SMA probe 140 for feeding a linear polarized (LP) signal from a coaxial cable 300 to a feed point in the antenna 100. The SMA probe 140 includes, for delivering EM energy to and/or from the antenna 100, an outer conductor 302 which is electrically connected to the ground plane 108, an inner (or feed) conductor 304 which is electrically connected to the transmission strip 116, and an annular dielectric 306 coaxially interposed between the inner and outer conductors 302 and 304, respectively. While the SMA probe 140 is preferred, any suitable coaxial probe and/or connection arrangement may be used to implement the foregoing connections. For example, a conductive adhesive (not shown) may be used to bond and maintain contact between the inner conductor 304 and the transmission strip 116, and an appropriate seal (not shown) may be applied where the SMA probe 140 passes through the ground plane 108 to hermetically seal the connection. Though not shown, it is understood that an end 306 of the SMA probe 140, not connected to the antenna 100, is connectable via a coaxial cable (not shown) to, for example, a signal generator or to a receiver, such as a satellite signal decoder used with television signals. As discuss further below with respect to FIG. 5, the circuitry 150 is depicted in FIG. 3 as having lead lines 506 and 508.

Figure 4:
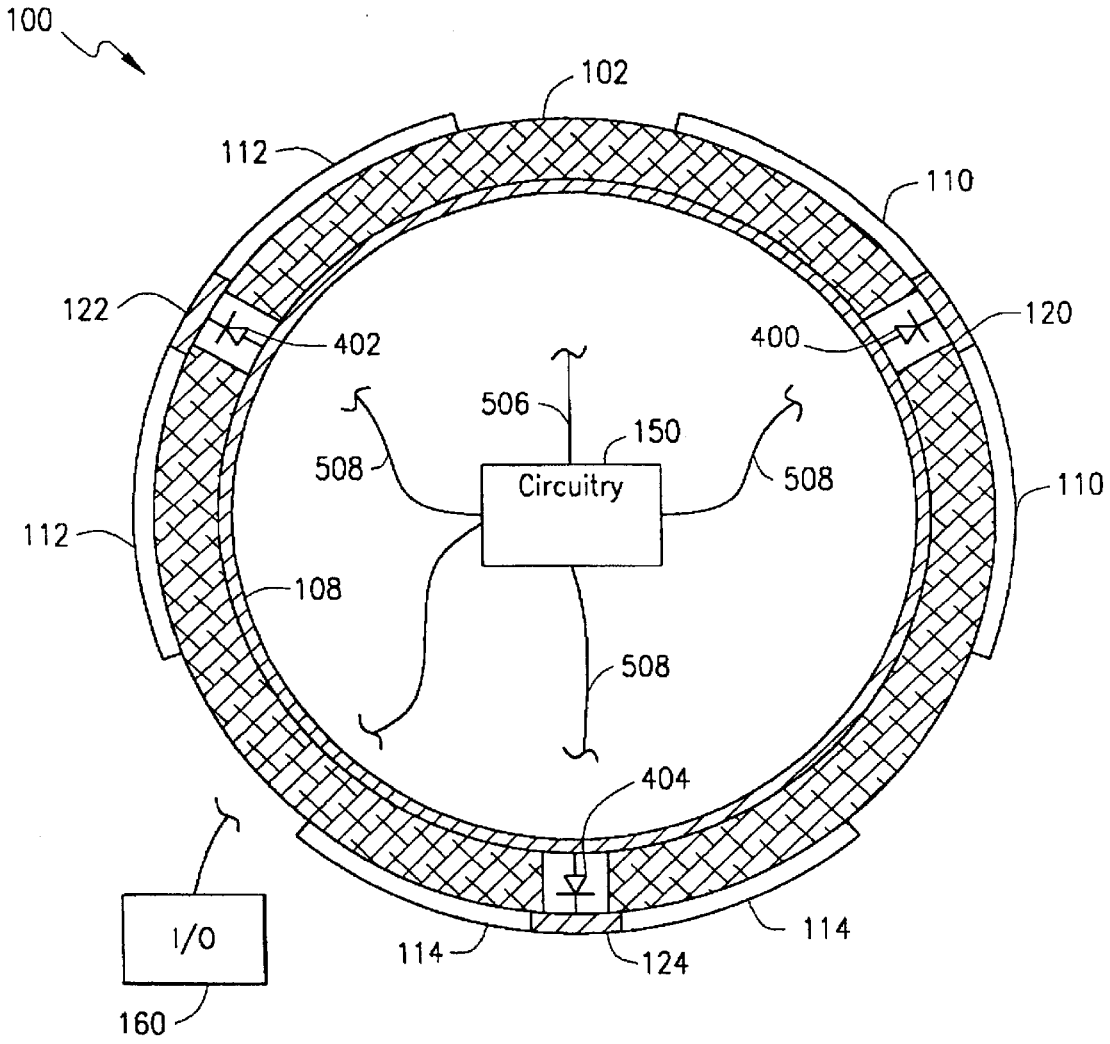
FIG. 4 is a planar view of the antenna of FIG. 1 taken along the line 4—4 of FIG. 1, and depicting diodes utilized by the antenna of FIG. 1 for controlling beam direction.

As shown in FIG. 4, diodes 400, 402, and 404 are preferably embedded within the dielectric 102, and connected between the ground plane 108 and the gated strips 120, 122, and 124, respectively. While not shown, the diodes 400, 402, and 404 may, alternatively, be located outside the dielectric 102, provided they are connected between the ground plane 108 and the respective gated strips 120, 122, and 124. The diodes 400, 402, and 404 are preferably PIN diodes configured for operation with high-frequencies, such as frequencies exceeding 1 GHz.

Figure 5:
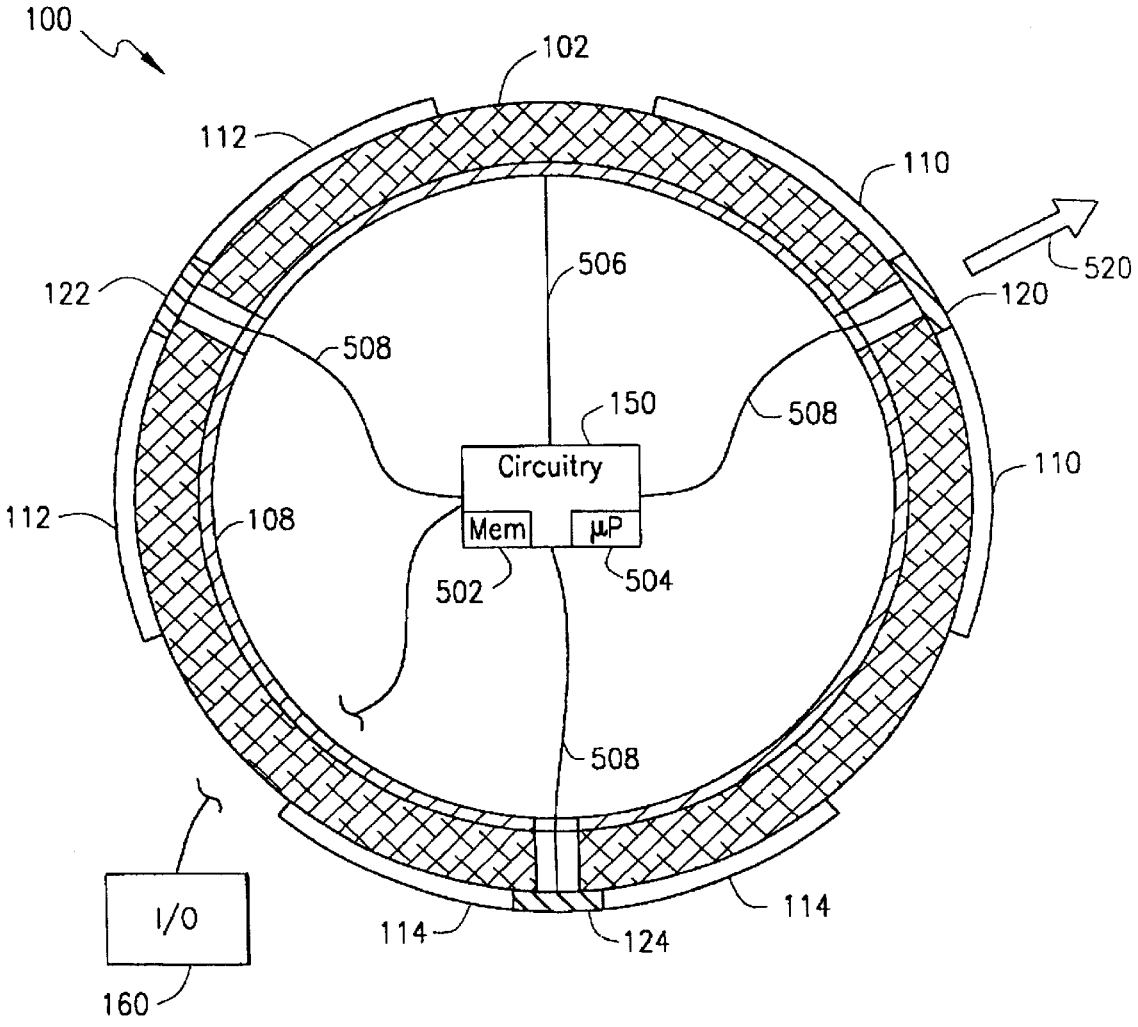
FIG. 5 is a planar view of the antenna of FIG. 1 taken along the line 5—5 of FIG. 1, and depicting circuitry utilized by the antenna of FIG. 1.

As shown in FIG. 5, the antenna 100 is provided with circuitry 150 having a memory 502 and a microprocessor 504 operatively connected thereto. The circuitry 150 is electrically connected via a line 506 for grounding the ground plane 108, and for switchably supplying a DC voltage potential (which may be positive or negative) via lines 508 to a selected one or more of the gated strips 120, 122, and 124. The voltage potential to the gated strips relative to the ground plane, as applied by the circuitry 150, is sufficient to create a reverse bias in the diodes 400, 402, and/or 404 (FIG. 4), thereby allowing the transmission of a signal from the transmission strip 116 to a respective antenna element 110, 112, and/or 114. Operation of the circuitry 150 is directed by the microprocessor 504 in accordance with control logic embedded therein, discussed below with respect to FIG. 6. While not shown, a input device, such as a manually operated switch, a computer keyboard, or the like, well-known in the art, may be connected to the circuitry 150 for directing the circuitry, as discussed below, to transmit or receive a beam to or from a particular direction, or to identify a direction from which a beam has been transmitted.

In the transmission of a beam in a particular desired direction, such as the direction indicated schematically by the arrow 520 in FIG. 5, for example, a signal is passed through the coaxial cable 300 (FIG. 3) and the SMA probe 140 to the ground plane 108 and to the transmission strip 116. Passage of the signal from the transmission strip 116 to the antenna elements 110, 112, and 114 is a function of the bias of the diodes 400, 402, and 404. The bias of each diode 400, 402, and 404 is determined by the DC voltage potential applied across the respective diodes by the circuitry 150, which is operatively directed by the input device 160 to transmit a beam in the direction of the arrow 520, in the present example. Upon being so directed by the input device 160 to transmit a beam in the direction of the arrow 520, the circuitry 150 applies DC voltage potential via the line 506 and the respective lines 508 to create a forward voltage bias in the diodes 402 and 404 which correspond to the respective antenna elements 112 and 114 which do not face the desired direction in which the beam is to be directed, i.e., which have surfaces which are not generally perpendicular to the desired direction of the beam. As a result, each of the diodes 402 and 404 enter into a forward bias state which inhibits the passage of the signal from the transmission strip 116 through the respective capacitors 132 and 132 and gated strips 122 and 124 to the respective antenna elements 112 and 114. It is noted that capacitors 402 and 404 inhibit the DC voltage potential applied across the diodes 402 and 404 to be conducted to the transmission strip 116.

As a result of the foregoing, the diode 400 is left in a reverse bias state and permits the passage of the signal from the transmission strip 116 through the respective capacitor 130 and gated strip 120 to the respective antenna element 110.

The foregoing description of the method of the present invention for directing a beam through a particular antenna element, exemplified as the antenna element 110, would be performed in a similar manner for directing a beam through any other antenna element, such as the antenna elements 112 or 114, as would be apparent a person having ordinary skill in the art upon a reading of the foregoing, and will therefore not be described in further detail herein.

It is well-known that antennas transmit and receive signals reciprocally. It can be appreciated, therefore, that operation of the antenna 100 for receiving signals is reciprocally identical to that of the antenna for transmitting signals. The receiving of signals by the antenna 100 will, therefore, not be further described herein, except with respect to identifying the direction from which a signal is received, which is discussed below.

Figure 6:
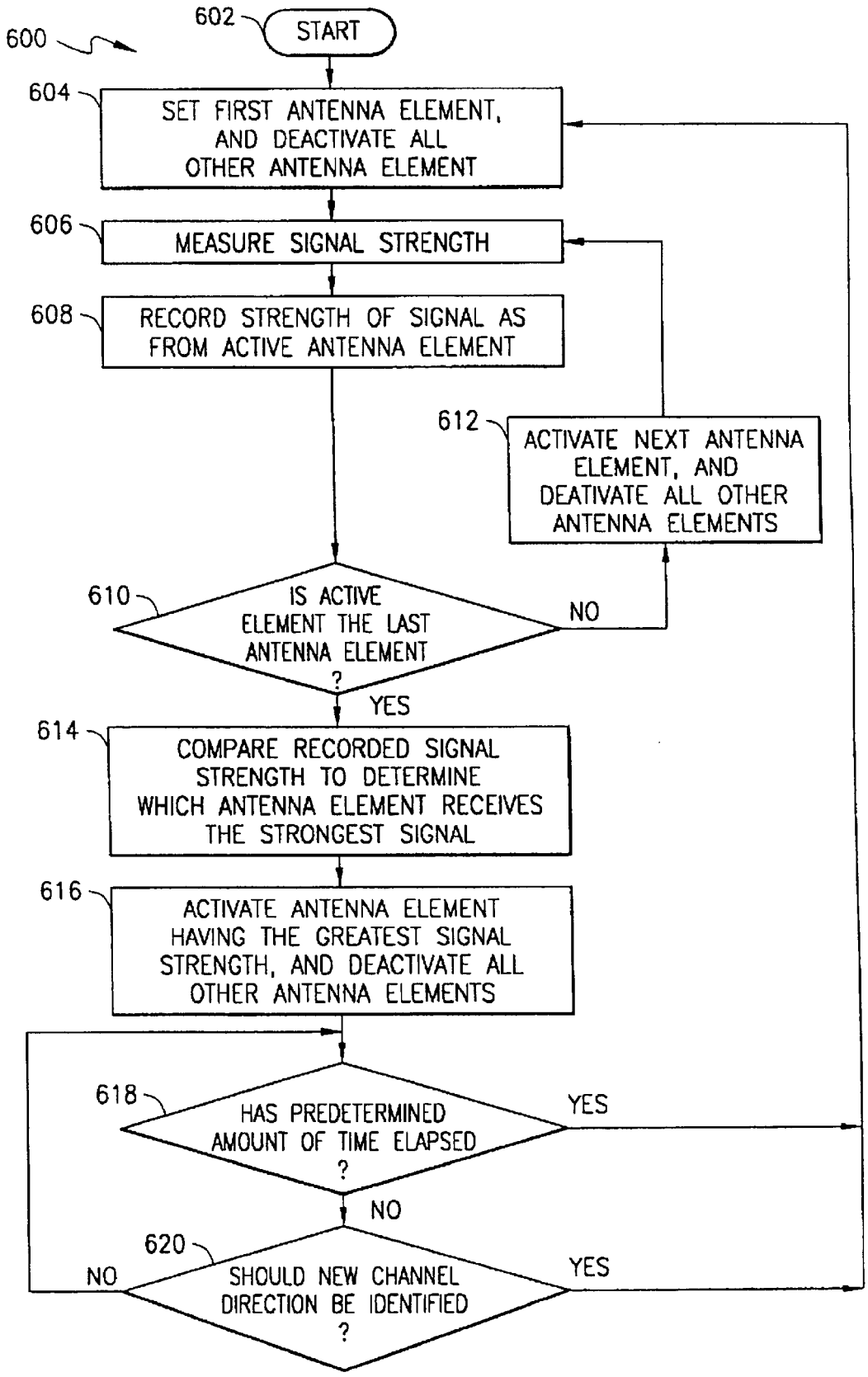
FIG. 6 is a flow chart illustrating control logic utilized by the antenna of FIG. 1 for direction-finding.

FIG. 6 depicts a flowchart 600 of control logic implemented by the antenna 100 for determining a direction from which a EM signal beam is received, in accordance with the present invention. In step 602, power is applied to the circuitry 150 and, in step 604, an antenna element designated as a "first" antenna element is activated. For the sake of illustration, the first antenna element will taken herein as the antenna element 110. The antenna element 110 is activated by placing the diode 400 in a reverse bias state, as discussed above. While the antenna element 110 is activated, the other antenna elements 112 and 114 are deactivated by placing the diodes 402 and 404 in a forward bias state, as discussed above.

In step 606, the strength of a signal, which is received substantially only through the activated antenna element 110, is measured at the coaxial cable 300 (FIG. 3) in a conventional manner. In step 608, the measured signal and the antenna element 110 through which the measured signal was received is recorded in the memory 504 of the circuitry 150.

In step 610, a determination is made whether the activated antenna element 110 is the last antenna element to be activated. Since, in the present example, the antenna elements 112 and 114 have not been activated, the antenna element 110 is not the last antenna element to be activated. Therefore, execution proceeds to step 612.

In step 612, the next antenna element, taken as the antenna element 112 in the present example, is activated, and the other antenna elements 110 and 114 are deactivated, and execution returns to step 606.

In step 606, the strength of a signal, which is received substantially only through the activated antenna element 112, is measured at the coaxial cable 300 (FIG. 3) in a conventional manner. In step 608, the measured signal and the antenna element 112 through which the measured signal was received is recorded in the memory 504 of the circuitry 150.

In step 610, a determination is made whether the activated antenna element 112 is the last antenna element to be activated. Since, in the present example, the antenna element 114 has not been activated, the antenna element 112 is not the last antenna element to be activated. Therefore, execution proceeds to step 612.

In step 612, the next antenna element, taken as the antenna element 114 in the present example, is activated, and the other antenna elements 110 and 112 are deactivated, and execution returns to step 606.

In step 606, the strength of a signal, which is received substantially only through the activated antenna element 114, is measured at the coaxial cable 300 (FIG. 3) in a conventional manner. In step 608, the measured signal and the antenna element 114 through which the measured signal was received is recorded in the memory 504 of the circuitry 150.

In step 610, a determination is made whether the activated antenna element 114 is the last antenna element to be activated. Since, in the present example, all of the antenna elements 110, 112, and 114 have been activated, the antenna element 114 is the last antenna element to be activated. Therefore, execution proceeds to step 614.

In step 614, the strength of the signal received upon activation of each of the antenna elements 110, 112, and 114 is compared to determine which antenna element received the signal with the greatest strength. Upon determining which antenna element 110, 112, and 114 has received the signal with the greatest strength, in step 616, that antenna element is activated, and the other antenna elements are deactivated, as discussed above.

In step 618, a determination is made whether a predetermined amount of time, such as one second, has elapsed since the most recent execution of step 616. If it is determined that such a predetermined amount of time has elapsed, then execution returns to step 604; otherwise, execution proceeds to step 620.

In step 620, a determination is made whether a direction of a new frequency channel should be identified, which may occur, for example, from input entered through the input device 160. If it is determined that a direction of a new frequency channel should be identified, then execution returns to step 604; otherwise, execution returns to step 618.

Figure 7:
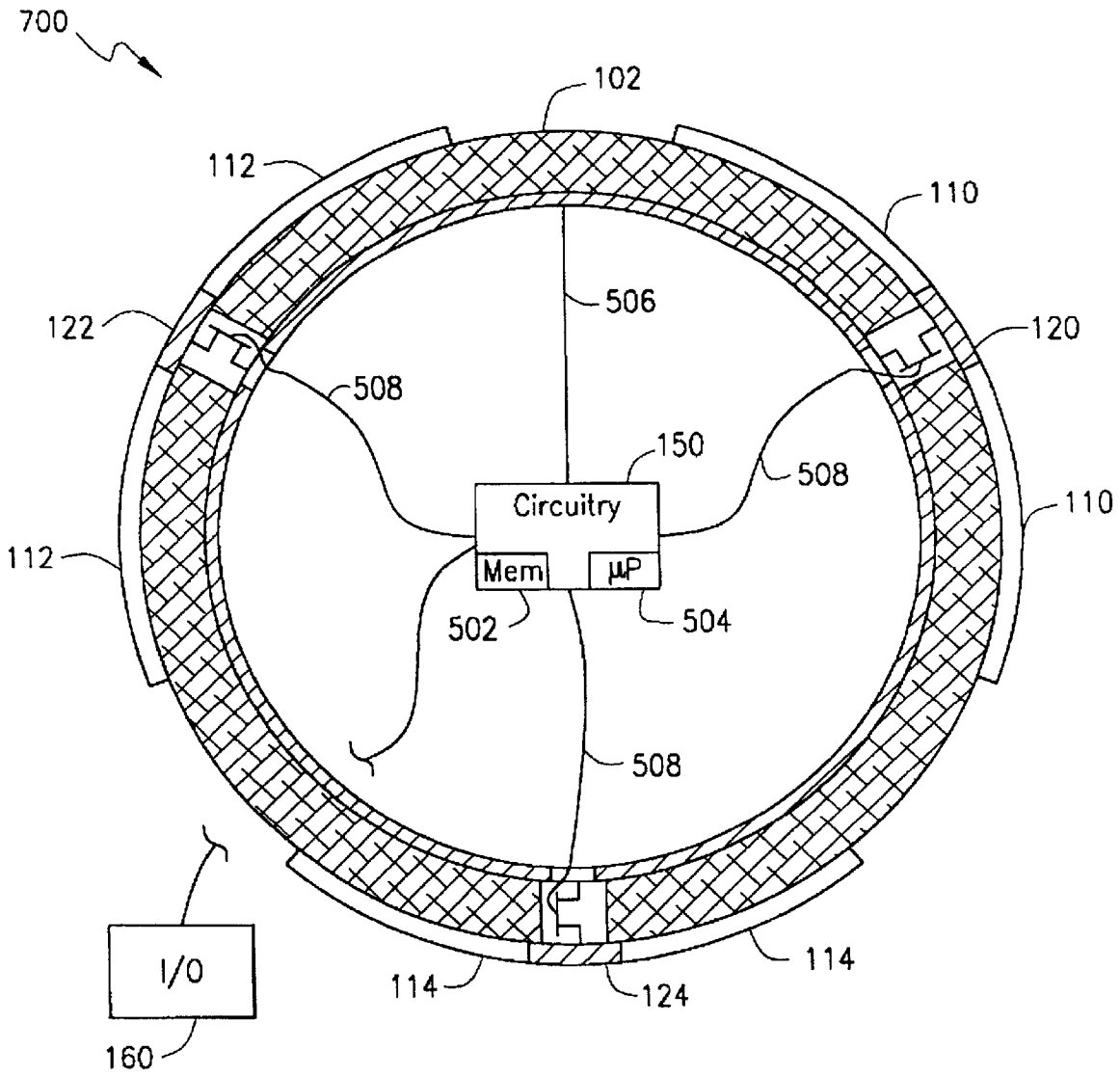
FIG. 7 is a planar view of an alternate embodiment of the present invention, taken along the line 7—7 of FIG. 1, which utilizes transistors for controlling beam direction.

FIG. 7 depicts an alternate embodiment 700 of the present invention wherein FET transistors are used in lieu of diodes for controlling which antenna elements 110, 112, and/or 114 are activated. Accordingly, FET transistors 700, 702, and 704 are embedded in the dielectric 102, with leads connected to the ground plane 108, and to the respective gated strips 120, 122, and 124, and gates connected to the circuitry 150 via the lines 508. While FET transistors are shown in FIG. 7, MOSFET transistors may also be used, and other types of transistors, such as BJT NPN and BJT PNP transistors may be used rather than FET transistors. Operation of the embodiment depicted in FIG. 7 is otherwise substantially similar to the operation of the previous embodiment, and will therefore not be described in further detail herein.

Figure 8:
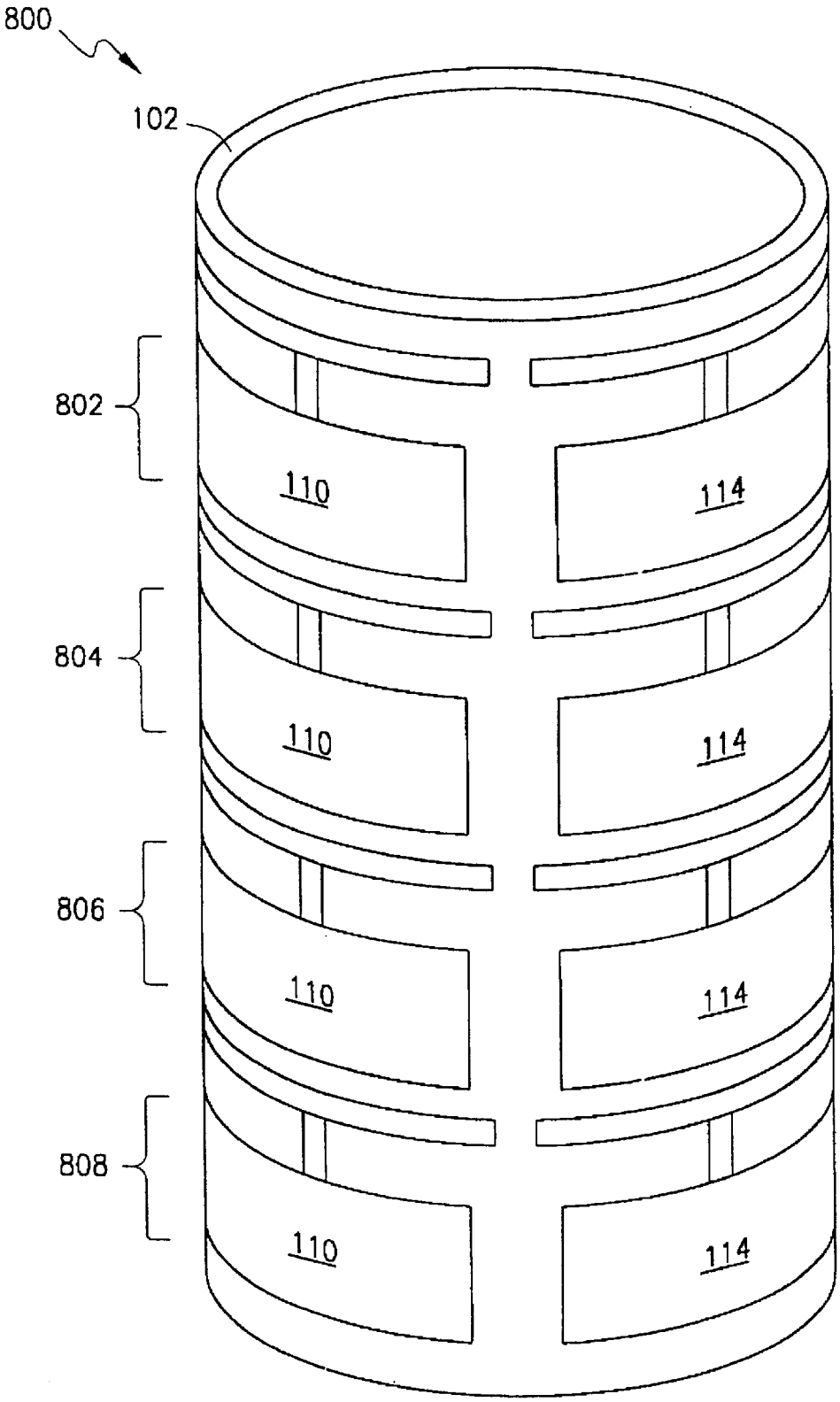
FIG. 8 is a perspective view of an alternate embodiment of the present invention adapted for multiple channels.

FIG. 8 depicts a second alternate embodiment of the present invention wherein multiple arrays 802, 804, 806, and 808 of antenna elements 110, 112, and 114, configured substantially as described above with respect to the embodiments of FIGS. 1–6 and/or of FIG. 7, are positioned on the single dielectric 102 for transmitting and receiving EM beams of multiple frequencies, and/or with greater directivity than would be possible with a single array of antenna elements. While not shown as such, the antenna elements depicted in FIG. 8 in one array 802, 804, 806, or 808 may be sized differently from antenna elements in another array 802, 804, 806, or 808 to the facilitate different frequencies of each channel on which beams are to be transmitted and/or received. Operation of the embodiment depicted in FIG. 8 is otherwise substantially similar to the operation of the previous embodiments, and will therefore not be described in further detail herein.

Figure 9:
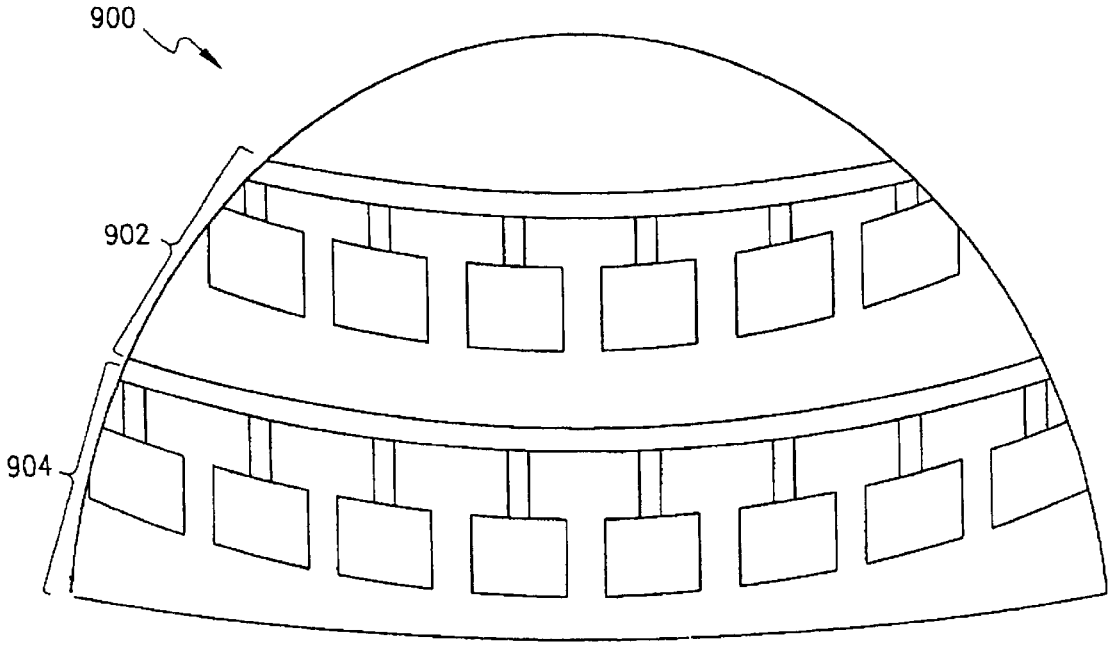
FIG. 9 is a perspective view of an alternate embodiment of the present invention adapted for steering beams in two dimensions.

FIG. 9 depicts a third alternate embodiment of the present invention wherein two arrays 902 and 904 of antenna elements configured substantially as described above with respect to the antenna elements 110, 112, and 114, of the previous embodiments, are laid out as arrays on a hemisphere for facilitating two-dimensional beam steering. Operation of the embodiment depicted in FIG. 9 is otherwise substantially similar to the operation of the previous embodiments, and will therefore not be described in further detail herein.

By the use of the present invention, an electronically steerable antennas may be inexpensively fabricated for transmitting and receiving signals in any of a number of different directions, and for finding the direction of an incoming beam.

It is understood that the present invention can take many forms and embodiments. Accordingly, several variations may be made in the foregoing without departing from the spirit or the scope of the invention. For example, more than three antenna elements may be wrapped around the dielectric 102, and multiple adjacent antenna elements may be activated simultaneously to enhance the directivity of a beam transmitted to or received by the antenna. The cross-section of the dielectric may be polygonal (e.g., triangular, square, octagonal, and the like), with n sides, on each of which sides an antenna element is positioned. Embodiments of the antennas configured in accordance with the present invention may be adapted for use in cellular telecommunications and radio and television broadcasting.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. An antenna comprising:

a dielectric layer configured about a longitudinal axis, and having at least two surface portions which face outwardly from the longitudinal axis in at least two different directions;

a conductive ground plane bonded to each of the at least two surface portions;

at least two conductive antenna elements bonded to the dielectric layer on each of the at least two surface portions and configured to radiate a signal therefrom;

a transmission strip configured to transmit a signal; and at least two gated strips configured to respectively connect, via an electrical switch, each of the at least two conductive antenna elements to the transmission strip.

2. The antenna of claim 1 wherein each of the at least two gated strips comprises a diode connected between a respective gated strip and the ground plane, and a capacitor serially connected between the transmission strip and the respective gated strip.

3. The antenna of claim 1 wherein each of the at least two gated strips comprises a PIN diode connected between a respective gated strip and the ground plane, and a capacitor serially connected between the transmission strip and the respective gated strip.

4. The antenna of claim 1 wherein each of the at least two gated strips comprises a transistor connected between a respective gated strip, the ground plane, and control circuitry, and a capacitor serially connected between the transmission strip and the respective gated strip.

5. The antenna of claim 1 wherein the dielectric layer comprises a cylindrical cross-section.

6. The antenna of claim 1 wherein the dielectric layer comprises a polygonal cross-section.

7. The antenna of claim 1 wherein the dielectric layer comprises a rectangular cross-section.

8. The method of claim 1 wherein each of the at least two conductive antenna elements is generally rectangularly-shaped in two dimensions.

9. The antenna of claim 1 further comprising a control circuit configured to control each switch so that only one conductive antenna element communicates a signal at a time.

10. The antenna of claim 1 further comprising a control circuit connected to each switch, said control circuit comprising:

control logic configured to control each switch so that only one conductive antenna element communicates a signal at a time;

control logic configured to sequentially close each switch so that the signal is received through one conductive antenna element at a time;

control logic configured to determine which conductive antenna element receives the signal with the greatest strength; and control logic configured to maintain for a predetermined period of time closure of a corresponding switch connected to the conductive antenna element determined to receive the signal with the greatest strength.

11. The antenna of claim 1 wherein the antenna is adapted for use in one of cellular telecommunications, radio broadcasting, or television broadcasting.

12. A method for configuring an antenna comprising:

configuring a dielectric layer about a longitudinal axis, and the dielectric layer having at least two surface portions which face outwardly from the longitudinal axis in at least two different directions;

bonding a conductive ground plane to each of the at least two surface portions;

bonding at least two conductive antenna elements to the dielectric layer on each of the at least two surface portions for radiating a signal therefrom;

configuring a transmission strip for transmitting a signal; and switchably connecting, via respective electrical switches, at least two gated strips between the transmission strip and each of the at least two conductive elements.

13. The method of claim 12 further comprising connecting a diode between each of the at least two gated strips and the ground plane, and serially connecting a capacitor between the transmission strip and a respective gated strip.

14. The method of claim 12 further comprising connecting a PIN diode between each of the at least two gated strips and the ground plane, and serially connecting a capacitor between the transmission strip and a respective gated strip.

15. The method of claim 12 further comprising connecting a transistor between each of the at least two gated strips, the ground plane, and control circuitry, and serially connecting a capacitor between the transmission strip and a respective gated strip.

16. The method of claim 12 wherein the dielectric layer comprises a cylindrical cross-section.

17. The method of claim 12 wherein the dielectric layer comprises a polygonal cross-section.

18. The method of claim 12 wherein the dielectric layer comprises a rectangular cross-section.

19. The method of claim 12 wherein each of the at least two conductive antenna elements is generally rectangularly-shaped in two dimensions.

20. The method of claim 12 further comprising controlling each switch so that only one conductive antenna element communicates a signal at a time.

21. The method of claim 12 further comprising connecting circuitry to each switch, said circuitry being adapted for:

controlling each switch so that only one conductive antenna element communicates a signal at a time;

closing each switch so that the signal is received through one antenna element at a time;

determining which antenna element receives the signal with the greatest strength; and maintaining for a predetermined period of time closure of the corresponding switch connected to the antenna element determined to receive the signal with the greatest strength.

22. The method of claim 12 further comprising adapting the antenna for use in one of cellular telecommunications, radio broadcasting, or television broadcasting.

23. An antenna comprising:

a dielectric layer configured about a longitudinal axis, and having at least two surface portions which face outwardly from the longitudinal axis in at least two different directions;

a conductive ground plane bonded to each of the at least two surface portions;

at least two conductive antenna elements bonded to the dielectric layer on each of the at least two surface portions and configured to radiate a signal therefrom;

a transmission strip configured to transmit a signal; and at least two gated strips switchably connecting the transmission strip to each of the at least two conductive antenna elements, wherein each of the at least two gated strips comprises a diode connected between a respective gated strip and the ground plane, and a capacitor serially connected between the transmission strip and the respective gated strip.

24. An antenna comprising:

a dielectric layer configured about a longitudinal axis, and having at least two surface portions which face outwardly from the longitudinal axis in at least two different directions;

a conductive ground plane bonded to each of the at least two surface portions;

at least two conductive antenna elements bonded to the dielectric layer on each of the at least two surface portions and configured to radiate a signal therefrom;

a transmission strip configured to transmit a signal; and at least two gated strips switchably connecting the transmission strip to each of the at least two conductive antenna elements, wherein each of the at least two gated strips comprises a PIN diode connected between a respective gated strip and the ground plane, and a capacitor serially connected between the transmission strip and the respective gated strip.

25. An antenna comprising:

a dielectric layer configured about a longitudinal axis, and having at least two surface portions which face outwardly from the longitudinal axis in at least two different directions;

a conductive ground plane bonded to each of the at least two surface portions;

at least two conductive antenna elements bonded to the dielectric layer on each of the at least two surface portions and configured to radiate a signal therefrom;

a transmission strip configured to transmit a signal; and at least two gated strips switchably connecting the transmission strip to each of the at least two conductive antenna elements, wherein each of the at least two gated strips comprises a transistor connected between a respective gated strip, the ground plane, and control circuitry, and a capacitor serially connected between the transmission strip and the respective gated strip.

26. An antenna comprising:

a dielectric layer configured about a longitudinal axis, and having at least two surface portions which face outwardly from the longitudinal axis in at least two different directions;

a conductive ground plane bonded to each of the at least two surface portions;

at least two conductive antenna elements bonded to the dielectric layer on each of the at least two surface portions and configured to radiate a signal therefrom;

a transmission strip configured to transmit a signal; and at least two gated strips switchably connecting the transmission strip to each of the at least two conductive antenna elements, wherein the dielectric layer comprises a cylindrical cross-section.

27. An antenna comprising:

a dielectric layer configured about a longitudinal axis, and having at least two surface portions which face outwardly from the longitudinal axis in at least two different directions;

a conductive ground plane bonded to each of the at least two surface portions;

at least two conductive antenna elements bonded to the dielectric layer on each of the at least two surface portions and configured to radiate a signal therefrom;

a transmission strip configured to transmit a signal; and at least two gated strips switchably connecting the transmission strip to each of the at least two conductive antenna elements, wherein the dielectric layer comprises a polygonal cross-section.

28. An antenna comprising:

a dielectric layer configured about a longitudinal axis, and having at least two surface portions which face outwardly from the longitudinal axis in at least two different directions;

a conductive ground plane bonded to each of the at least two surface portions;

at least two conductive antenna elements bonded to the dielectric layer on each of the at least two surface portions and configured to radiate a signal therefrom;

a transmission strip configured to transmit a signal;

at least two gated strips switchably connecting the transmission strip to each of the at least two conductive antenna elements; and a control circuit connected to each switch, said control circuit comprising:

control logic configured to control each switch so that only one conductive antenna element communicates a signal at a time;

control logic configured to sequentially close each switch so that the signal is received through one conductive antenna element at a time;

control logic configured to determine which conductive antenna element receives the signal with the greatest strength; and control logic configured to maintain for a predetermined period of time closure of a corresponding switch connected to the conductive antenna element determined to receive the signal with the greatest strength.

29. A method for configuring an antenna comprising:

configuring a dielectric layer about a longitudinal axis, and the dielectric layer having at least two surface portions which face outwardly from the longitudinal axis in at least two different directions;

bonding a conductive ground plane to each of the at least two surface portions;

bonding at least two conductive antenna elements to each dielectric layer on each of the at least two surface portions for radiating a signal therefrom;

configuring a transmission strip for transmitting a signal;

switchably connecting at least two gated strips between the transmission strip and each of the at least two conductive elements; and connecting a diode between each of the at least two gated strips and the ground plane, and serially connecting a capacitor between the transmission strep and the respective gated strip.

30. A method for configuring an antenna comprising:

configuring a dielectric layer about a longitudinal axis, and the dielectric layer having at least two surface portions which face outwardly from the longitudinal axis in at least two different directions;

bonding a conductive ground plane to each of the at least two surface portions;

bonding at least two conductive antenna elements to each dielectric layer on each of the at least two surface portions for radiating a signal therefrom;

configuring a transmission strip for transmitting a signal;

switchably connecting at least two gated strips between the transmission strip and each of the at least two conductive elements; and connecting a PIN diode between each of the at least two gated strips and the ground plane, and serially connecting a capacitor between the transmission strip and the respective gated strip.

31. A method for configuring an antenna comprising:

configuring a dielectric layer about a longitudinal axis, and the dielectric layer having at least two surface portions which face outwardly from the longitudinal axis in at least two different directions;

bonding a conductive ground plane to each of the at least two surface portions;

bonding at least two conductive antenna elements to each dielectric layer on each of the at least two surface portions for radiating a signal therefrom;

configuring a transmission strip for transmitting a signal;

switchably connecting at least two gated strips between the transmission strip and each of the at least two conductive elements; and connecting a transistor between each of the at least two gated strips, the ground plane, and control circuitry, and serially connecting a capacitor between the transmission strip and a respective gated strip.

32. A method for configuring an antenna comprising:

configuring a dielectric layer about a longitudinal axis, and the dielectric layer having at least two surface portions which face outwardly from the longitudinal axis in at least two different directions;

bonding a conductive ground plane to each of the at least two surface portions;

bonding at least two conductive antenna elements to each dielectric layer on each of the at least two surface portions for radiating a signal therefrom;

configuring a transmission strip for transmitting a signal; and switchably connecting at least two gated strips between the transmission strip and each of the at least two conductive elements, wherein the dielectric layer comprises a cylindrical cross-section.

33. A method for configuring an antenna comprising:

configuring a dielectric layer about a longitudinal axis, and the dielectric layer having at least two surface portions which face outwardly from the longitudinal axis in at least two different directions;

bonding a conductive ground plane to each of the at least two surface portions;

bonding at least two conductive antenna elements to each dielectric layer on each of the at least two surface portions for radiating a signal therefrom;

configuring a transmission strip for transmitting a signal; and switchably connecting at least two gated strips between the transmission strip and each of the at least two conductive elements, wherein the dielectric layer comprises a polygonal cross-section.

34. A method for configuring an antenna comprising:

configuring a dielectric layer about a longitudinal axis, and the dielectric layer having at least two surface portions which face outwardly from the longitudinal axis in at least two different directions;

bonding a conductive ground plane to each of the at least two surface portions;

bonding at least two conductive antenna elements to each dielectric layer on each of the at least two surface portions for radiating a signal therefrom;

configuring a transmission strip for transmitting a signal;

switchably connecting at least two gated strips between the transmission strip and each of the at least two conductive elements; and connecting circuitry to each switch, said circuitry being adapted for:

controlling each switch so that only one conductive antenna element communicates a signal at a time;

closing each switch so that the signal is received through one conductive antenna element at a time;

determining which conductive antenna element receives the signal with the greatest strength; and maintaining for a predetermined period of time closure of the switch connected to the corresponding conductive antenna element determined to receive the signal with the greatest strength.

* * * * *

UNITED STATES PATENT AND TRADEMARK OFFICE

CERTIFICATE OF CORRECTION

PATENT NO. : 6,281,847 B1
DATED : August 28, 2001
INVENTOR(S) : Choon Sae Lee

It is certified that error appears in the above-identified patent and that said Letters Patent is hereby corrected as shown below:

Column 1,
Line 49, delete “wellknown” and insert -- well-known --.

Column 3,
Line 28, after “such” insert -- as --;
Line 37, delete “□” and insert -- λ --.

Column 5,
Line 44, delete “132” (first occurrence) and insert -- 130 --;
Line 59, after “apparent” insert -- to --.

Column 6,
Line 9, after “will” insert -- be --.

Column 12,
Line 17, delete “strep” and insert -- strip --.

Signed and Sealed this

Ninth Day of July, 2002

*Attest:*

*Attesting Officer*

JAMES E. ROGAN
*Director of the United States Patent and Trademark Office*